United States Patent [19]

Groos et al.

[11] 4,206,626

[45] Jun. 10, 1980

[54] EXTRUSION PRESS FOR EXTRUDING TUBES

[75] Inventors: Horst H. Groos; Urban Richardt, both of Metzkausen; Siegfried Hoffmeier, Dusseldorf, all of Fed. Rep. of Germany

[73] Assignee: Schloemann-Siemag Aktiengesellschaft, Dusseldorf, Fed. Rep. of Germany

[21] Appl. No.: 874,631

[22] Filed: Feb. 2, 1978

[30] Foreign Application Priority Data

Feb. 4, 1977 [DE] Fed. Rep. of Germany ..... 2704652

[51] Int. Cl.[2] ..... B21C 23/00; B21C 23/10

[52] U.S. Cl. ..... 72/265; 72/253 R

[58] Field of Search ..... 72/253, 260, 255, 264, 72/265

[56] References Cited

U.S. PATENT DOCUMENTS

| | | | |
|---|---|---|---|
| 2,063,563 | 12/1936 | Sparks | 72/265 |
| 2,672,234 | 3/1954 | Lorant | 72/265 |
| 2,903,130 | 9/1959 | Reichl | 72/264 |
| 3,391,566 | 7/1968 | Linnerz et al. | 72/265 |
| 3,468,152 | 9/1969 | Croseck et al. | 72/265 |
| 3,651,680 | 3/1972 | Groos | 72/265 |
| 3,664,168 | 5/1972 | Shtin | 72/265 |
| 3,675,457 | 7/1972 | Groos | 72/265 |
| 3,709,013 | 1/1973 | Petsch | 72/265 |
| 4,050,281 | 9/1977 | Sibler | 72/265 |

FOREIGN PATENT DOCUMENTS

| | | | |
|---|---|---|---|
| 233891 | 4/1911 | Fed. Rep. of Germany | 72/265 |
| 1216633 | 5/1966 | Fed. Rep. of Germany | 72/293 |
| 1268458 | 5/1968 | Fed. Rep. of Germany | 72/293 |
| 47-23772 | of 1972 | Japan | 72/302 |
| 1263907 | 2/1972 | United Kingdom | 72/265 |
| 1279332 | 6/1972 | United Kingdom | 72/293 |

*Primary Examiner*—Daniel C. Crane
*Assistant Examiner*—D. M. Gurley
*Attorney, Agent, or Firm*—Holman & Stern

[57] ABSTRACT

In tube extrusion presses, there are two steps in production. Firstly, a mandrel pierces a hole through the center of a billet, the tip of the mandrel ending up just within the opening of the extrusion die. Secondly, the now hollow cylindrical billet is extruded through the die and over and around the tip of the mandrel to produce a tube. To limit the movement of the mandrel, stroke-limiting rods are provided which pass through bores in a part attached to the mandrel and in a fixed part of the press. The rods can be held fast in one or both of these bores, or released to slide through them, depending on the stage reached in the extrusion process.

10 Claims, 6 Drawing Figures

EXTRUSION PRESS FOR EXTRUDING TUBES

FIELD OF THE INVENTION

The invention relates especially to metal tube-making presses with a so-called internal billet piercing device, i.e. a cylinder and piston of the piercing device are arranged in the main press piston of the press. The piston of the piercing device is fixed to a piercing cross-bar which is slidably guided in the movable beam of the press, the ends of the arms of the cross-bar cooperating with the mandrel stroke-limiting rods.

Mandrel stroke-limiting rods are provided to take up the tensile forces acting on the mandrel during extrusion of a billet to a tube over the top of a fixed mandrel. In this way the tensile forces which arise are transmitted from the mandrel through the piercing cross-bar to the mandrel stroke-limiting rods, which may be linked to the piercing cross-bar by means of stops or by other means. These mandrel stroke-limiting rods conduct the tensile forces to a fixed part of the press, generally the cylinder cross-head.

As the mandrels are in general of differing lengths, wear playing a part in this, exact setting of the mandrel point in the opening of the die, in extrusion of a tube over a so-called fixed mandrel, was formerly carried out by means of threaded spindles and spindle nuts with associated drive means. These are usually linked to the mandrel stroke-limiting rods in the cylinder cross-head or in the piercing cross-bar.

BACKGROUND OF THE INVENTION

An arrangement of threaded spindle and spindle nut in the piercing cross-bar for limitation of the mandrel stroke is known for example from British Pat. No. 929,056. Here the mandrel stroke-limiting rods are fixed at one end in the cylinder cross-head and carry stops at their other end, opposite the counter platen. The piercing cross-bar is supported against these stops by their one stroke and thereby by that of the mandrel-limiting threaded nut, which is adjustable by means of a threaded spindle.

Further, another arrangement is known from U.S. Pat. No. 3,391,566, in which the stroke of the mandrel stroke-limiting rods is adjustable by means of threads on the rods and a threaded nut arranged in the piercing cross-bar, and the mandrel stroke-limiting rods, with an abutment located at their free end, come up against a stop device, in the cylinder cross head. Also in this case there is provided a hydraulic piercing device, consisting of cylinder and piston, in the main press piston of the press.

The constructional expense for the provision of threaded spindles, spindle nuts and a central drive system is relatively large. Furthermore, in extruding over the mandrel which is fixed in the opening of the die, the opposing pressure which arises towards the end of the extrusion process on the annular surface of the mandrel tip, due to the difference in cross-sectional areas of the mandrel and the undercut mandrel tip, must be taken up through the piercing piston and piercing cylinder from the main press piston. The force thereby created in the piercing cylinder by the opposing pressure is therefore subtracted from the pressing force.

SUMMARY OF THE INVENTION

The object of the invention is therefore, in place of the costly threaded spindles with associated drives, to provide an arrangement for adjustable limitation of the mandrel stroke or positioning of the mandrel tip, which is simple, space-saving and of low cost, and wherein compressive forces can be transmitted through the mandrel stroke-limiting system into the cylinder cross-head without loss of pressing force.

According to the invention, there is provided an extrusion press for extruding tubes, the press including a counter platen, a cylinder cross-head, tension columns joining the counter platen and the cylinder cross-head, a movable cross-head able to be moved between the counter platen and cylinder cross-head, and a press stem carried by the movable cross-head for movement therewith to carry out an extrusion operation, the press also including a piercing device carried by the movable cross-head, which device comprises a piercing mandrel, a piston and cylinder arrangement for driving the mandrel relative to the movable cross-head, a piercing cross-bar fixed to the mandrel, and axially movable mandrel stroke-limiting rods arranged parallel to the direction of movement of the movable cross-head and the mandrel, each rod being received in a bore in the piercing cross-bar and in a bore in the cylinder cross-head, releasable clamping means being provided in each of the bores to releasably clamp the stroke-limiting rods.

By means of this arrangement, both tensile and compressive forces can be transmitted from the mandrel through the piercing cross-bar and the mandrel stroke-limiting rods to the fixed cylinder cross-head. In this way the entire press force of the main press cylinder is available for extrusion of the billet to a tube, without being affected by the absorption of the opposing pressure from the mandrel tip.

Advantageously the clamping elements in the cylinder cross-head and piercing cross-bar surround the mandrel stroke-limiting rods. The clamping elements may embrace the mandrel stroke-limiting rods, which are preferably of circular cross-section, as clamping sleeves or clamping shells which are hydraulically or mechanically actuated. It is equally effective if the clamping elements are clamping jaws which can be tightened around the mandrel stroke-limiting rods.

In a further development of the invention, the clamping sleeves or clamping jaws in the cylinder cross-head and in the piercing cross-bar can be selectively tightened alternately or simultaneously. In the case of alternate tightening, i.e. either in the cylinder cross-head or in the piercing cross-bar, the following cases are possible:

In the first case the mandrel stroke-limiting rods are held in the cylinder cross-head, and the piercing cross-bar therefore slides along the fixed rods. The mandrel may either pierce a billet in the billet container of the press or may enter the opening of the die in the pierced billet for positioning.

In the second case, i.e. in clamping in the piercing cross-bar and sliding of the rods through the cylinder cross-head, either the rods can be moved back by pulling back the piercing cross-bar, or the rods can be pushed forward by means of the piercing device.

Once the mandrel stroke-limiting rods are clamped or tightened in both the cylinder cross-head and in the piercing cross-bar, the opposing pressure which arises towards the end of the pressing stage of the mandrel tip can be transmitted through the mandrel, the piercing cross-bar, the clamping sleeve, the mandrel stroke-limiting rods and the further clamping sleeves directly to the fixed cylinder cross-head. Thus the entire pressing force is available for the extrusion process.

Advantageously the mandrel stroke-limiting rods are provided at their free end facing the counter platen of the press with stops for the piercing cross-bar which carries the mandrel or the mandrel shaft. The piercing cross-bar moves up against these stops, so that on clamping of the rods in the cylinder cross-head the mandrel tip is positioned in the die opening.

The mandrel stroke-limiting rods may consist of smooth shafts, which are provided, at their ends only, with larger diameter portions, e.g. nuts as stops.

With the new arrangement, in pressing over a fixed mandrel tip, the full pressing force is always available. The length of the press becomes shorter, since the piercing cross-bar is more lightly than was formerly the case and the height of the piercing cross-bar, seen in the direction of pressing, can be made less. The lack of threaded spindle and nut also contributes to the smaller constructional height of the piercing cross-bar. Furthermore the mandrel stroke-limiting rods can be made weaker than hitherto. The costly working of the threads for the mandrel stroke adjustment and the drive for adjustment of the mandrel stroke limiting rods by means of the threaded rings is also thereby dispensed with.

In the hydraulic system, an opposing pressure for the piercing cylinder, to take up the opposing pressure on the mandrel towards the end of the extrusion stage, is also dispensed with.

To control the position of the mandrel stroke-limiting rods relative to the piercing cross-bar, in a further development of the invention, the mandrel stroke-limiting rods are connected at their end which is in the cylinder cross-head with a tensioning device which is supported on the cylinder cross-head itself, parallel to the press axis and operating against the extrusion direction. The tensioning device consists of tensioning members formed as ties, cables, or chains, which are wound round pulleys which exert a resilient torque. Instead of a spring force exerted on the tension members by the pulleys, counterweights may be provided at the free ends of these members, the tensioning members then passing over deflection pulleys.

BRIEF DESCRIPTION OF THE DRAWINGS

An example of the invention will be further explained with reference to drawings. The drawings show.

DETAILED DESCRIPTION OF THE EMBODIMENT

Figure 1:
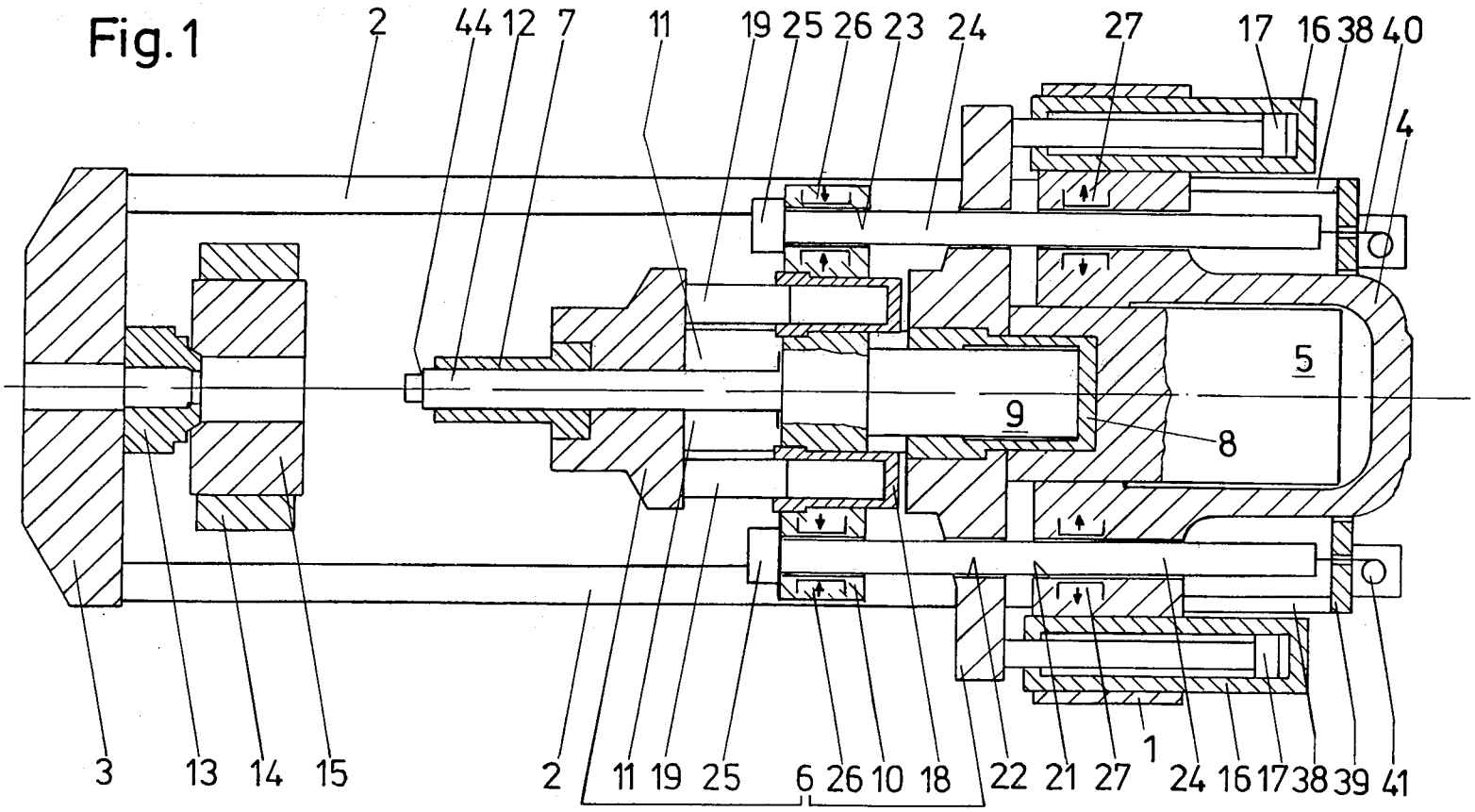
FIG. 1 in top view, in section, a metal tube-making press with a piercing device arranged in the main press piston, with retracted press stem and mandrel and retracted mandrel stroke-limiting rods.

A metal tube-making press consists essentially of a cylinder cross-head 1, which is fixed to a counter platen 3 by means of tension columns 2. In the cylinder of the cylinder cross-head 1 slides a press piston 5, to which is fixed a movable cross-head. A hollow press stem 7 is arranged on the movable cross-head 6. In the rear part of the movable cross-head and front part of the press piston 5 there is provided a piercing cylinder 8, in which slides a piercing piston 9. A piercing cross-bar 10 is fixed to the piston 9 and is slidably guided relative to the movable cross-head 6 in the windows 11 of the cross-head 6 to the right and left of the press axis.

A piercing mandrel 12, which is arranged on the cross-bar 10, slides in a bore in the front part of the movable cross-head 6 and the bore of the hollow press stem 7. A die 13 is provided on the counter platen 3, and a billet container 15 is pressed against the die by displacement means which are not shown, the billet container 15 being fixed in a holder 14.

For retraction of the movable cross-head 6 and thereby of the press stem 7 into its starting position, retraction cylinders 16 are provided in the cylinder cross-head 1, and pistons 17 which are fixed to the movable cross-head 6 and hydraulically activated are guided in the cylinders. In a similar manner, the piercing cross-bar 10 with the piercing mandrel 12 is retractable relative to the moving cross-head 6 into the starting position by retraction cylinders 18 which are arranged in the piercing cross-bar 10. Pistons 19 which are fixed to the movable cross-head 6 and are hydraulically activated to slide in the cylinders 18.

In bores 21 of the cylinder cross-head 1, which are arranged symmetrically with respect to the press axis, and through bores 22 of the movable cross-head 6 and also through bores 23 of the piercing cross-bar 10 extend mandrel stroke-limiting rods 24, which are provided with stops 25 at their ends directed towards the billet container 15. Hydraulically activated clamping elements 26 are provided in recesses in the bores 23 of the piercing cross-bar 10. Further hydraulically activated clamping elements 27 are arranged in recesses of the bores 21 of the cylinder cross-head 1. The clamping elements 26 and 27 are only schematically shown in FIGS. 1 to 4. In these figures, the direction of the arrows indicates the tightened condition in which the clamping elements are set in each case. The arrows in the direction towards the mandrel stroke limiting rods 24 indicate clamping of the mandrel stroke limiting rods 24 to the piercing cross-bar 10. In the case of the clamping elements 27 in FIG. 1 which are arranged in the cylinder cross-head 1 and schematically shown, the direction of the arrows is outwards, indicating that here the mandrel stroke-limiting rods 24 are freely axially movable with respect to the cylinder cross-head 1. The construction of these clamping elements 26 and 27 is shown in more detail in FIGS. 5 and 6, which are to a larger scale.

These clamping elements 26, 27 correspond in their construction to those disclosed in British Pat. No. 1,279,332.

Figure 5:
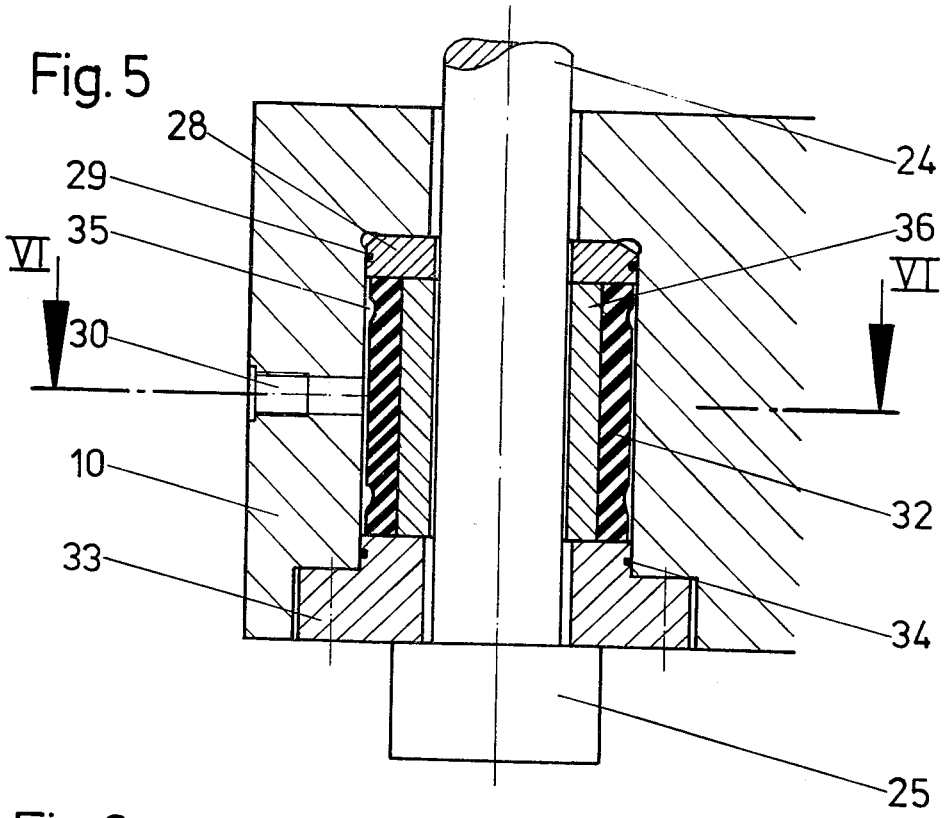
FIG. 5 a longitudinal section through the piercing cross-bar of the press with a clamping sleeve for the mandrel stroke-limiting rod, to a larger scale.
Figure 6:
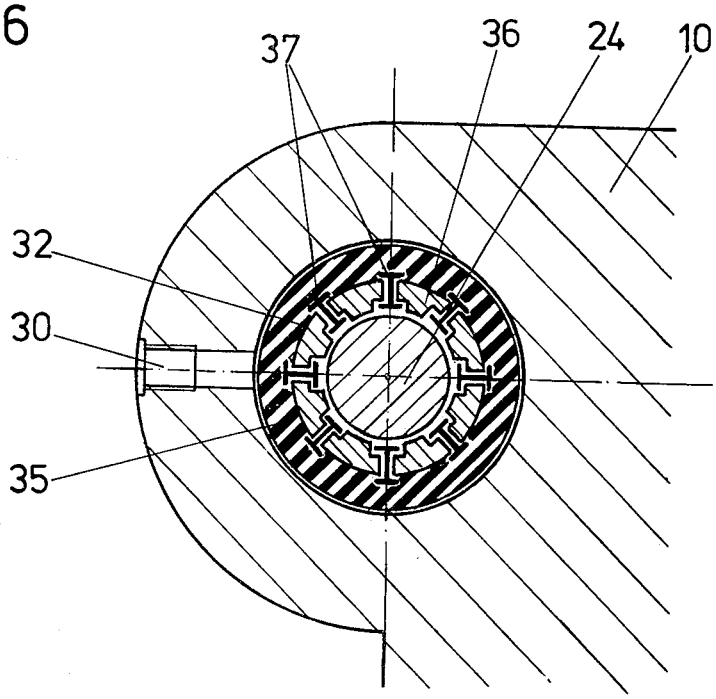
FIG. 6 a section along the line VI—VI of FIG. 5 through the piercing cross-bar, tightening sleeve and mandrel stroke-limiting rod.

In FIGS. 5 and 6, a ring 28 with a gasket 29 is arranged in a recess of the bores 23 of the piercing cross-bar 10. A rubber elastic cylindrical tightening sleeve 32 which can be actuated through bore 30 lies against the front face of the ring 28. Below, on the opposed front face of the tightening sleeve 32 there is fitted a further ring 33 in the form of a flange and having a gasket 34. The further ring 33 is fixed to the piercing cross-bar 10 in a releasable manner.

An annular space 35 is provided between the housing and recesses of the tightening sleeve 32. This annular space is hydraulically activated to clamp the tightening sleeve. On the inner surface of the tightening sleeve 32 there are provided tightening segments 36, which are held together as an annular ring by I-shaped or double T-shaped sections 37. These tightening segments 36, on activation of the tightening sleeve 32 by hydraulic fluid, lie tightly against the outer surface of the mandrel stroke-limiting rods 24, so that this latter can no longer move axially. When the pressure is removed from the tightening sleeves 32, the tightening segments 36 are released from the outer surface of the mandrel stroke-limiting rods 24.

In FIGS. 1 to 4, compression struts 38 are provided on the outer surface of the cylinder cross-head 1. These compression struts 38 are connected to each other by a cross-bar 39. In the lines of extension of the axes of the mandrel stroke limiting rods 24 there are provided cables, chains or ties 40, which are connected, at one end thereof, to the free ends of the mandrel stroke-limiting rod, and, at their other end, are fixed to pulleys 41 which are arranged on the cross-bar 39 and which are subjected to a torque tending to turn the pulleys so as to wind up the ties 40.

In this way it is ensured that when the tightening sleeve 32 is not under pressure the stops 25 of the mandrel stroke-limiting rods 24 always lie against the piercing cross-bar 10.

The manner of operation of the entire apparatus in piercing and extruding a tube from a block is as follows:

In the initial position of the press (see FIG. 1), the movable cross-head 6 and the piercing cross-bar 10 are retracted. The clamping elements 27 in the cylinder cross-head 1 are not under pressure and are therefore open. The clamping elements 26 in the piercing cross-bar 10 are under hydraulic pressure and therefore tightly grip the mandrel stroke-limiting rods 24. The stops 25 lie against the piercing cross-bar 10.

Figure 2:
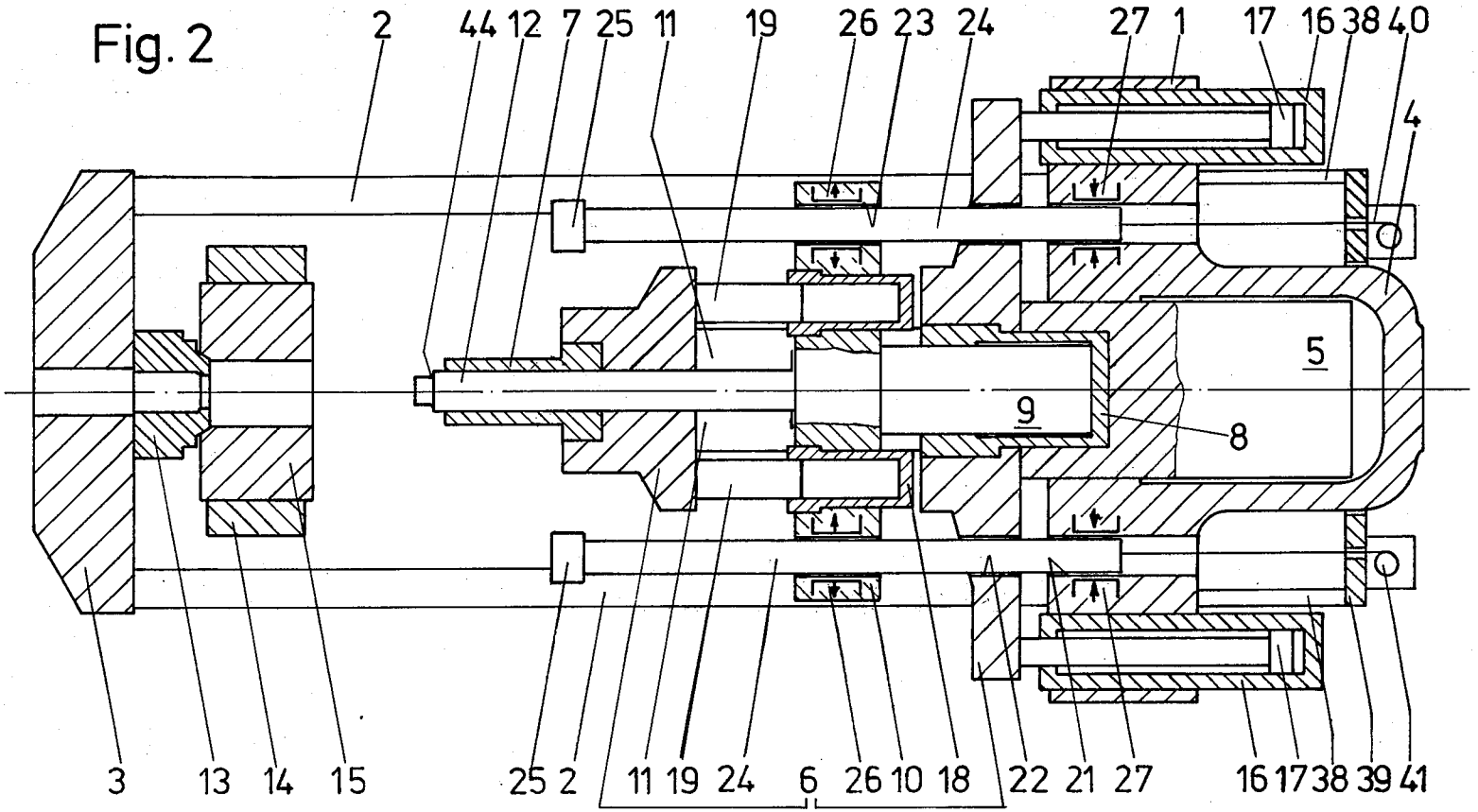
FIG. 2 the press in the basic position ready to start operation with correspondingly extended mandrel stroke-limiting rods.

In FIG. 2 the press is in the basic position ready to begin operation. The mandrel stroke-limiting rods 24, with their stops 25, are pulled out from the piercing cross-bar 10 a distance which is equal to the distance of the mandrel from the starting position of the press to the position of the mandrel point in the die opening. The rods are pushed forwards by means of the piercing cross-bar. The clamping elements 27 in the cylinder cross-head are correspondingly hydraulically activated and hold the mandrel stroke-limiting rods 24 fixed in this new position.

Figure 3:
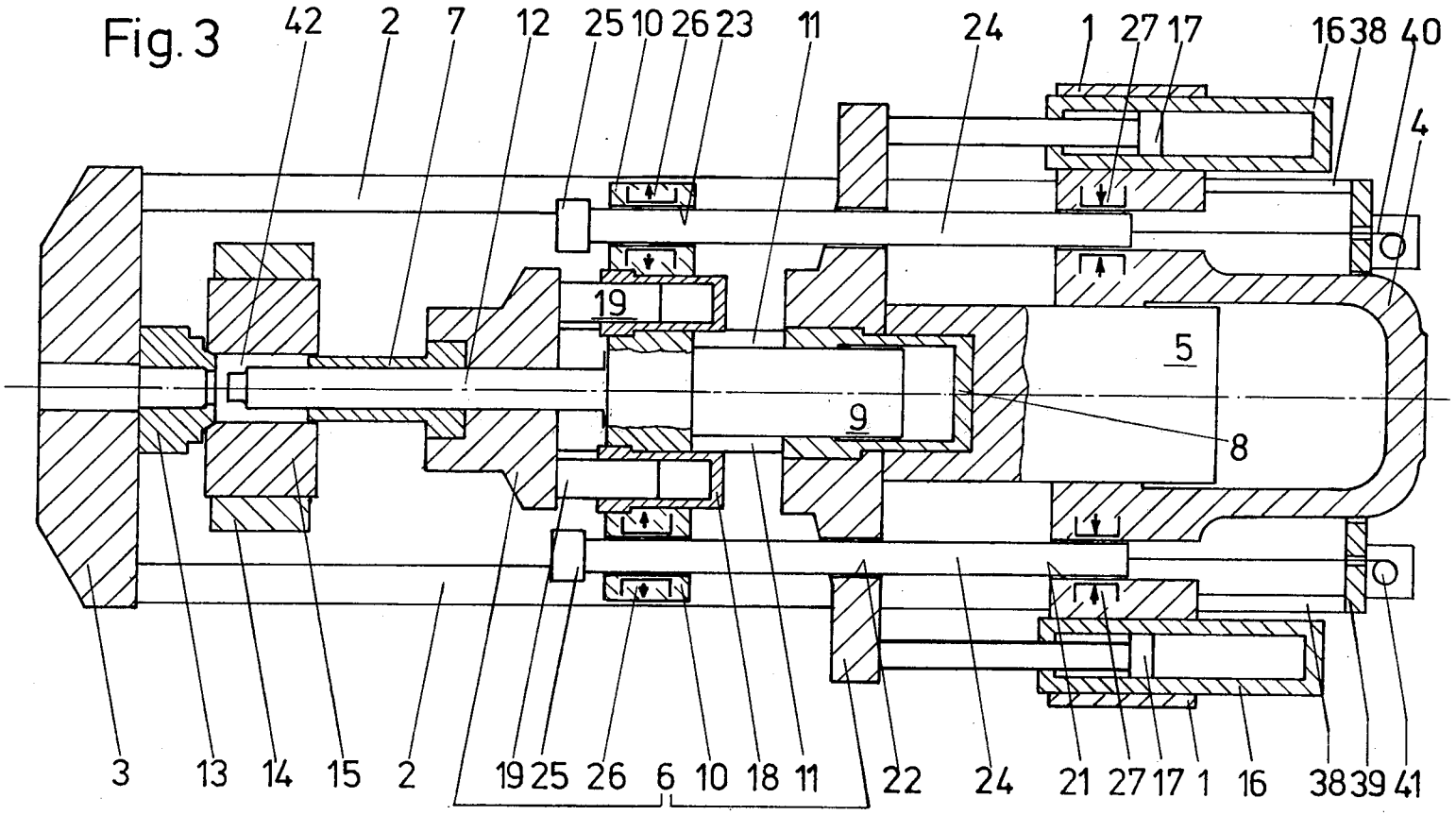
FIG. 3 the position of the press after piercing of a billet.

In FIG. 3, piercing of the billet 42, which is to be extruded, is completed. The distance between the piercing cross-bar 10 and the stops 25 corresponds to the further distance which must be travelled by the mandrel 12 before reaching the extrusion position in the die opening for extruding over a fixed mandrel tip.

Figure 4:
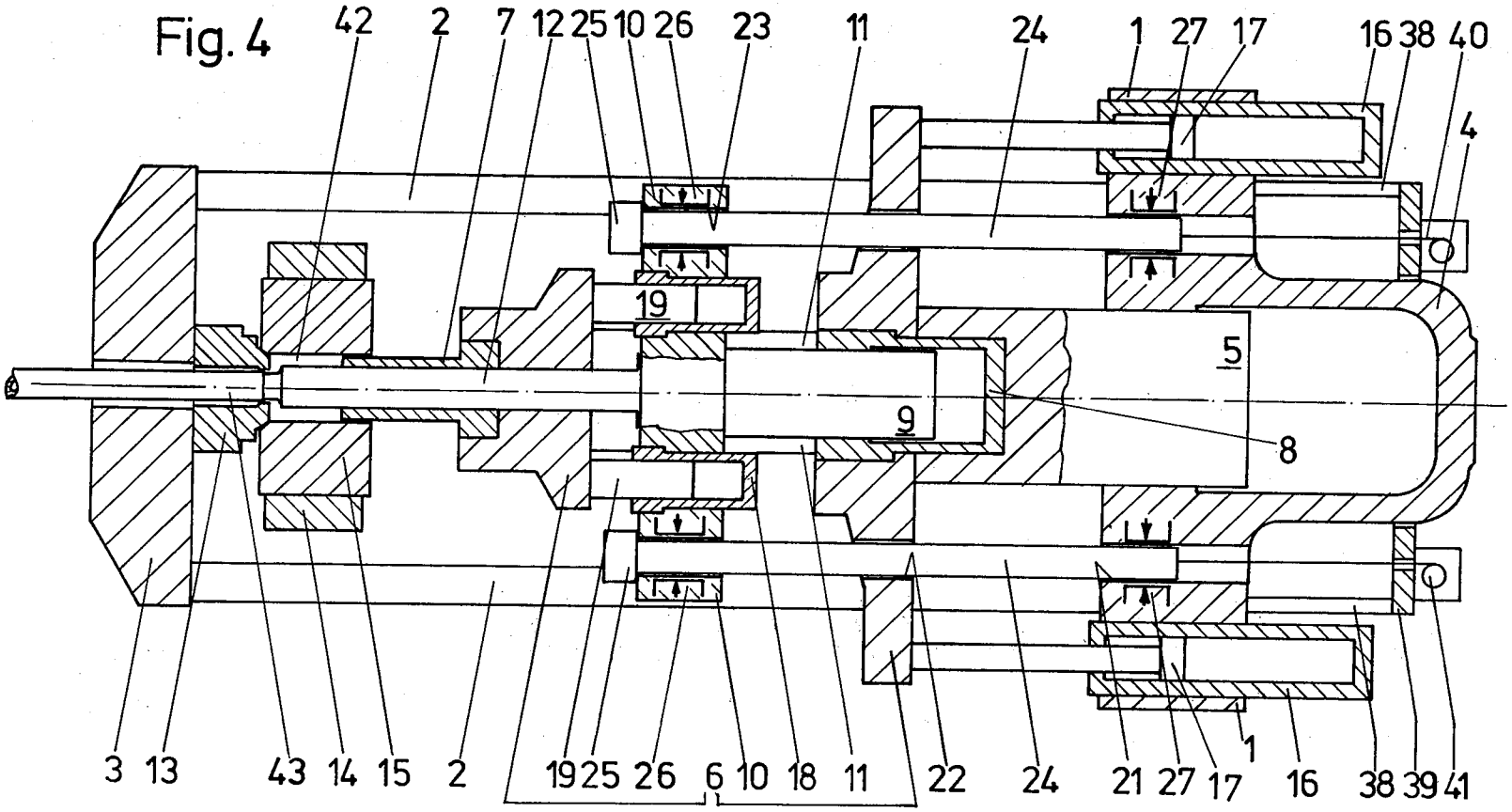
FIG. 4 the press when the mandrel tip has floated into the extrusion position after clamping with the piercing cross-bar, which is supported by the mandrel stroke-limiting rods.

In FIG. 4, the piercing cross-bar 10 lies against the stops 25 and these are tightly held, through the mandrel stroke-limiting rods 24, by means of the tightening elements 27 in the cylinder cross-head 1. The extrusion stage which is carried out by means of the press stem 7 driven by the press piston 5 via the movable cross-head 6 and sliding in the billet container 15 has now begun. At this stage the mandrel 12 is held stationary, and the cross-head 6, with cylinder 8 moves forward relative to piston 9. During this movement there is no pressure in cylinder 8. A part of a tube 43 has already been pressed out. Because of the friction between the billet material 42 and the mandrel 12, this latter is subjected to tension. The tension is transmitted through the piercing cross-bar 10, the stops 25 and the mandrel stroke-limiting rods 24 through the clamping elements 27 directly to the cylinder cross-head 1.

From a certain billet length in the bore of the billet container 15, the friction between the fixed mandrel 12 and the billet material, and therefore the tensile force on the mandrel, decreases. The tensile force suddenly turns into a compressive force, as the opposing pressure of the billet material on the annular surface 44 of the mandrel 12 becomes larger than the tensile force elicited by the friction. This compressive force can now be transmitted through the mandrel 12, the piercing cross-bar 10 and the clamping elements 26 to the mandrel stroke-limiting rods 24 and further through the clamping elements 27 directly to the cylinder cross-head, without the actual pressing force of the press being reduced. To this end, the clamping elements 26 in the piercing cross-bar are also hydraulically activated, to fix the mandrel stroke-limiting rods 24 to the piercing cross-bar 10. In the known presses, with an internal piercing device, this compressive force would act directly on the press piston with the result that the actual pressing force would be reduced by the not inconsiderably compressive force which is created around the mandrel tip.

We claim:

1. An extrusion press for extruding tubes, the press including a counter platen, an extrusion die mounted on said counter platen, a cylinder cross-head, tension columns joining the counter platen and the cylinder cross-head, a movable cross-head able to be moved between the counter platen and cylinder cross-head, a billet container movable between the counter platen and the cylinder cross-head and a press stem carried by the movable cross-head for movement therewith to extrude a billet in the container through the die, the press also including a piercing device carried by the movable cross-head, which device comprises a piercing mandrel, a piston and cylinder arrangement for driving said piercing mandrel relative to the movable cross-head, a piercing cross-bar fixed to said piercing mandrel, and axially movable mandrel stroke-limiting rods arranged parallel to the direction of movement of the movable cross-head and the mandrel, each rod being received in a bore in the piercing cross-bar and in a bore in the cylinder cross head, fluid pressure operated releasable clamping means being provided in each of the bores to releasably clamp the stroke-limiting rods and means for selectively applying fluid pressure to said clamping means in the bores of said piercing cross-bar and to said clamping means in the bores of said cylinder cross-head respectively.

2. The press of claim 1, wherein the clamping means surround the mandrel stroke-limiting rods.

3. The press of claim 2, wherein the clamping means are hydraulically activated.

4. The press of claim 1, wherein the stroke-limiting rods are of circular cross-section.

5. The press of claim 1, wherein the clamping means are clamping jaws.

6. The press of claim 1, wherein the clamping means are expandable and compressible sleeves.

7. The press of claim 1, wherein means are provided to tighten selectively alternately or simultaneously the clamping means in the cylinder cross-head and in the piercing cross-bar.

8. The press of claim 1, wherein the mandrel stroke-limiting rods are provided at their ends facing the counter platen with stops for the piercing cross-bar.

9. The press of claim 1, wherein the mandrel stroke-limiting rods are connected at their ends which are in the cylinder cross-head to tensioning devices which are supported on the cylinder cross-head itself, and act parallel to the press axis and against the extrusion direction.

10. The press of claim 9, wherein the tensioning devices consist of tensioning members in the form of ties, cables, or chains, which are wound round pulleys which exert a torque tending to wind up the tensioning members.

* * * * *